US005253974A

United States Patent [19]

Williams

[11] Patent Number: 5,253,974

[45] Date of Patent: Oct. 19, 1993

[54] GRAPPLE CLAMP FOR LIFTING GROUPS OF OBJECTS

[76] Inventor: John A. Williams, 932 E. 194 St., Glenwood, Ill. 60425

[21] Appl. No.: 977,774

[22] Filed: Nov. 17, 1992

[51] Int. Cl.[5] ..... B66F 9/18

[52] U.S. Cl. ..... 414/623; 294/87.1; 294/113; 414/607

[58] Field of Search ..... 294/62, 63.1, 67.1-67.21, 294/67.31, 67.33, 67.5, 81.3, 87.1, 88, 106, 113; 414/607, 608, 621, 623, 659, 660, 663, 673, 790.2, 791.8, 791.9, 792.9, 796.9

[56] References Cited

U.S. PATENT DOCUMENTS

| | | | |
|---|---|---|---|
| 1,466,524 | 8/1923 | Folland et al. | 294/67.21 |
| 2,924,484 | 2/1960 | Tolsma | 294/87.1 |
| 3,030,138 | 4/1962 | Bennett | 294/63.1 |
| 3,212,808 | 10/1965 | Breslav et al. | 294/87.1 X |
| 3,270,897 | 9/1966 | Lingl | 294/87.1 X |
| 3,675,961 | 7/1972 | Wheeler | 294/81.3 X |
| 4,252,496 | 2/1981 | Williams | 294/87.1 X |
| 5,141,274 | 8/1992 | Hayden et al. | 294/87.1 X |
| 5,161,934 | 11/1992 | Richardson | 294/87.1 X |

*Primary Examiner*—Johnny D. Cherry
*Attorney, Agent, or Firm*—Lockwood, Alex, FitzGibbon & Cummings

[57] ABSTRACT

A grapple clamp for lifting a group of objects such as a plurality of cases of soft drinks. The clamp has four clamp jaws hinged to a frame in rectangular or square orientation so as to engage a group of objects with equal force from four sides. The clamp is adapted to be carried by a fork lift truck and each pair of opposing jaw clamps is actuated by a hydraulic or pneumatic cylinder. Preferably, hydraulic cylinders are used which are powered by the hydraulic system of the lift truck. The cylinders are interconnected so that the clamping forces exerted by the two pairs of clamp jaws are equalized. A pressure regulator limits the pressure exerted by the opposing jaw clamps on objects. Provision is made to level the grapple clamp on the forks of a fork lift. A load stabilizer block is suspended within the frame. The grapple clamp is cantilever mounted on one side of the forks of a lift truck and a counterweight is mounted so as to counter balance the weight of the clamp and its load.

8 Claims, 3 Drawing Sheets

GRAPPLE CLAMP FOR LIFTING GROUPS OF OBJECTS

BACKGROUND AND DESCRIPTION OF THE INVENTION

This invention relates to improvements in grapple clamps disclosed in my U.S. Pat. No. 4,252,496 dated Feb. 24, 1981 which are adapted to be supported, maneuvered and operated from a conventional fork lift truck.

The important improvements and novel features in the hydraulically actuated grapple clamp of the present invention over the grapple clamp disclosed in my U.S. Pat. No. 4,252,496 are:

My improved grapple clamp is adapted to lift loads of objects which when pressed or clamped together in a group form a load to be lifted which does not have a solid or compaction resistant center;

The weight of the clamp and its load exerted on one side of the fore and aft center line of the lift truck is counterbalanced;

Leveling screws are provided which secure the grapple clamp in place on the forks of the fork lift truck and which may be adjusted so as to level the grapple clamp;

A load stabilizer block is suspended within the frame of the grapple clamp which serves to provide a solid core for a group of objects clamped together within the clamp which otherwise would be hollow in the center; and A pressure regulator is interconnected in the hydraulic system of the grapple clamp which limits the maximum clamping pressure which can be exerted on a load to be lifted.

The object of the invention, generally stated, is the provision of a grapple clamp incorporating the basic features of the grapple clamp disclosed in my U.S. Pat. No. 4,252,496 and which incorporates some or all of the above mentioned features and improvements thereon.

For a more complete understanding of the nature and scope of the invention, reference may now be had to the following detailed description of a preferred embodiment taken in conjunction with the accompanying drawings wherein.

Figure 7:
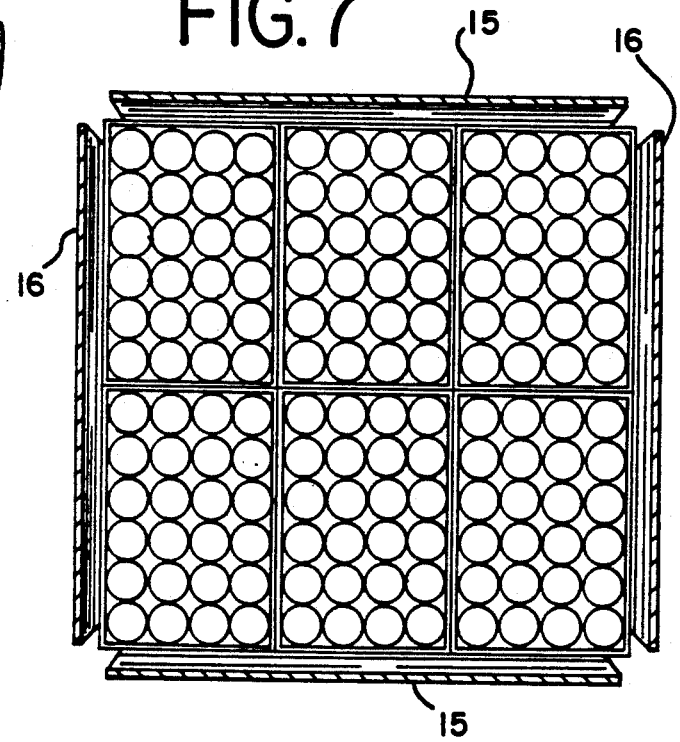
Figure 6:
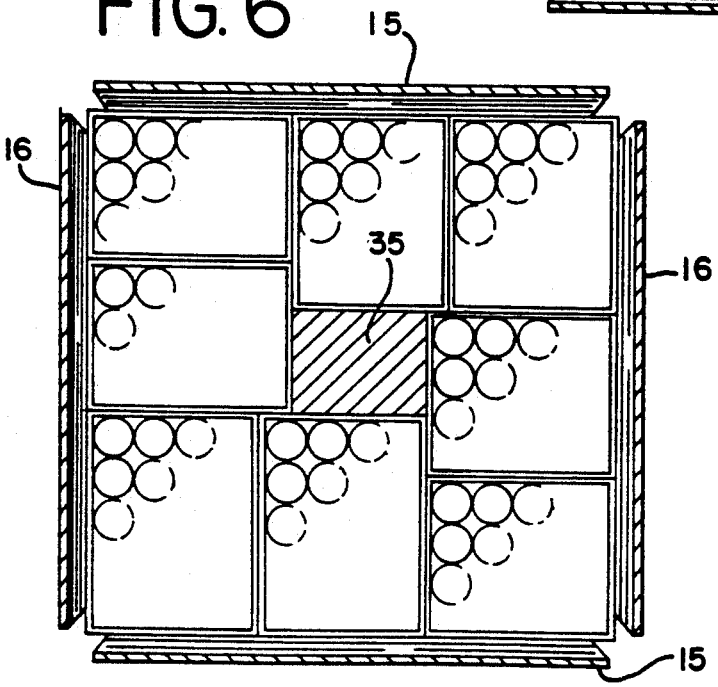
FIG. 6 is a sectional view taken on lines 6—6 of FIG. 1.

FIG. 7 is a sectional view corresponding to FIG. 6 and showing a load of objects to be lifted which does not require the assistance of a load stabilizing block and which corresponds to FIG. 6 of U.S. Pat. No. 4,252,496.

Figure 1:
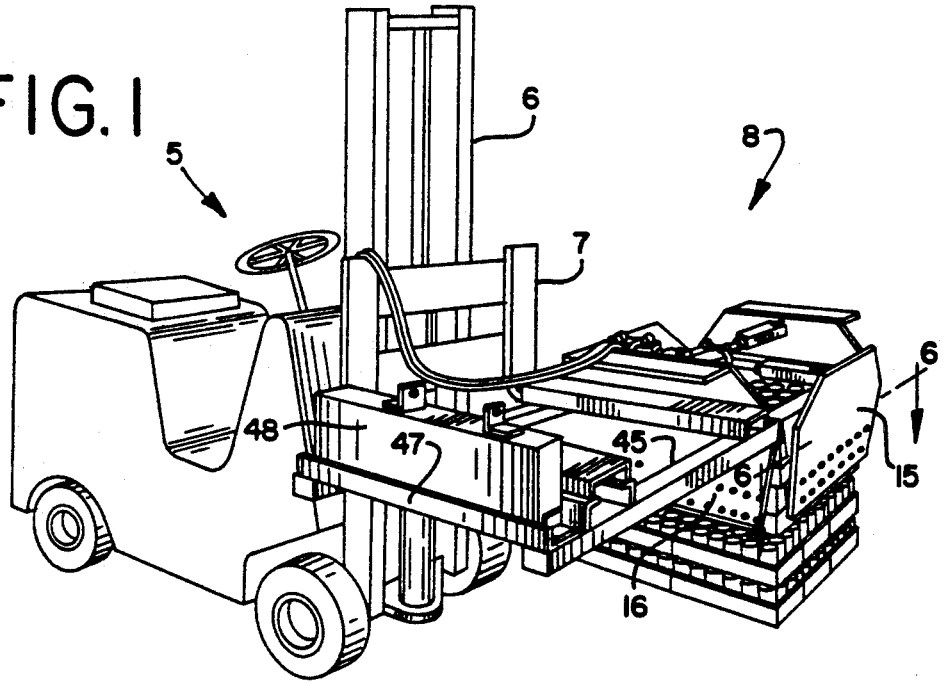
FIG. 1 is a perspective view showing a grapple clamp embodying the present invention mounted on the front end forks of a fork lift truck and positioned over a group of objects to be lifted.

In FIG. 1, a fork lift truck of conventional design and known commercial type is indicated generally at 5 having a fixed vertical mast 6 and vertically reciprocable fork lift attachment 7 mounted thereon with a pair of fork members 9—9 (FIGS. 3 and 4) projecting forwardly therefrom in the usual horizontal parallel spaced relationship. A grapple clamp made in accordance with the present invention and indicated generally at 8 is mounted on the forks 9 by suitable mounting means to be described in detail.

Figure 2:
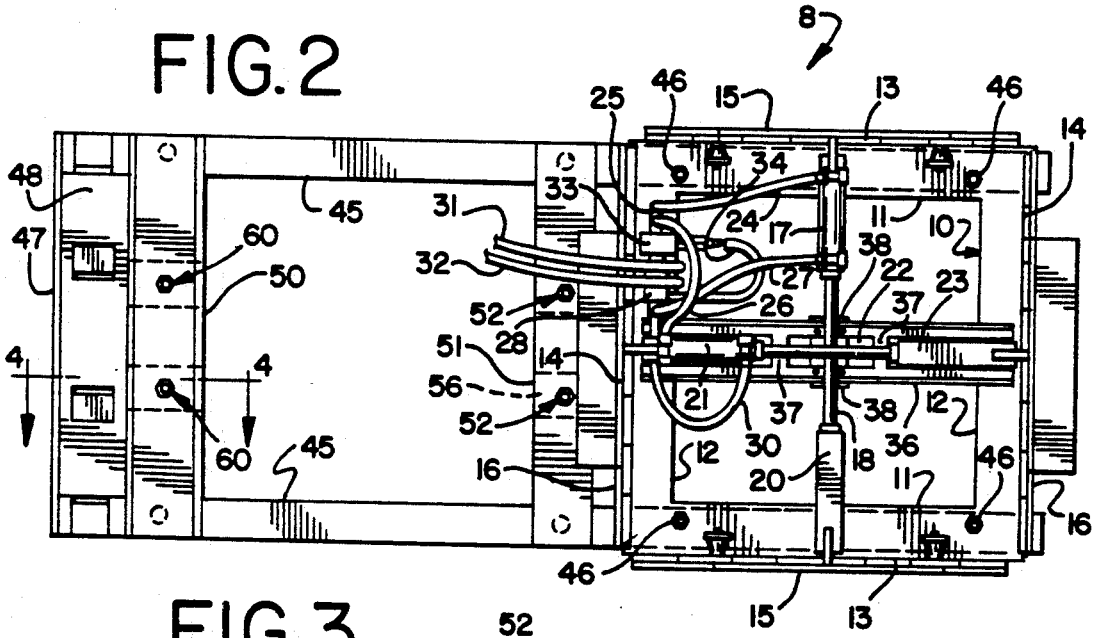
FIG. 2 is a top plan view of the grapple clamp shown in FIG. 1.
Figure 3:
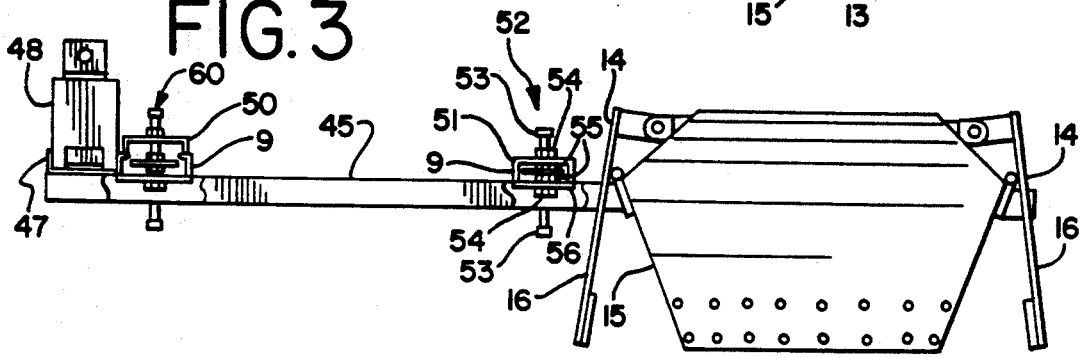
FIG. 3 is a elevational view of the clamp shown in FIG. 1 looking toward the front of the lift truck.
Figure 4:
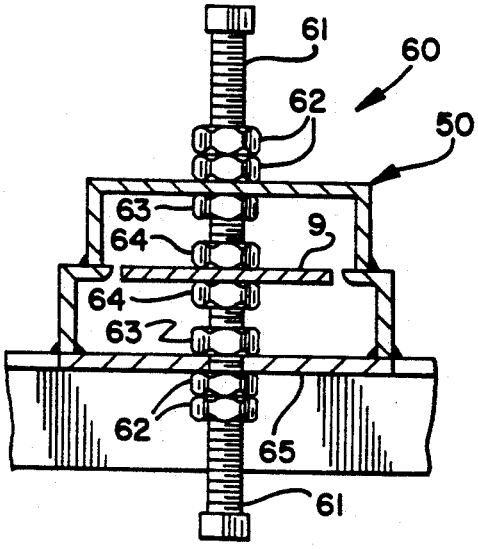
FIG. 4 is an enlarged fragmentary, vertical sectional view taken on lines 4—4 of FIG. 2.

The clamp 8 includes a square frame indicated generally at 10 in FIG. 2 and comprising two opposed side members 11—11 which are hollow and rectangular in cross-section and two opposed interconnecting side members 12—12 which may also be hollow and of rectangular cross-section. Piano hinges 13—13 are mounted adjacent the upper, outer corners of opposing sides 12—12 of the frame 10 (FIG. 2). A second pair of piano hinges 14—14 is mounted on the outer vertical walls of the opposing sides 12—12 (FIGS. 2 and 3). The free or swingable part of each hinge 13 has mounted thereon a clamp jaw 15. Likewise, the free or swingable part of each hinge 14 has mounted thereon a clamp jaw 16. The upper corners of each of the jaws 15 and 16 are removed so that the upper portions of each jaw above its respective hinge may be swung inwardly without interference when the grapple clamp 8 is actuated to its opened condition.

The upwardly projecting portions of the opposing clamp jaws 15 are operatively interconnected by a double-acting hydraulic cylinder 17 pivotally attached to one of the jaws 15. The outwardly extending piston rod 18 of the cylinder 17 carries a link 20 which is pivotally attached to the opposing clamp jaw 15. Likewise, the upwardly projecting portions of the clamp jaws 16 extending above their piano hinges 14 are operatively interconnected by a double-acting hydraulic cylinder 21 pivotally connected to one of the jaws 16 while its piston rod 22 is attached at its distal end to a link 23 pivotally connected to the opposing clamping jaw 16.

The vertical positioning of the hinges 13—13 and 14—14 and the spacing of the pivotal connections of the actuating cylinders 17 and 21 above the hinges is such that the moment arms through which the cylinders 17 and 21 act are equal. Accordingly, when equalized, hydraulic pressures are exerted on the cylinders 17 and 21 to swing the clamping jaws into clamping condition, the forces exerted by the clamping jaws will be equalized. Thus, the moment or leverage arm of each jaw 13—13 and 14—14 is the same so that the clamp force exerted by each jaw is the same.

It will be apparent that when the piston rods 18 and 22 of the cylinders 17 and 21, respectively, are extended, the upper portions of each jaw above its supporting piano hinge will be moved away from the upper portion of the opposing jaw, thereby swinging the lower depending clamping portions of each jaw inwardly toward each other. The pressure inlet connection of the cylinder 17 is connected by a hose 24 to a manifold 25. Likewise, the pressure inlet connection of the cylinder 21 is connected by a hose 26 to the manifold 25. The fluid discharge connection of the cylinder 17 is connected by a hose 27 to a manifold 28 while the fluid discharge connection of the cylinder 21 is similarly connected by a hose 30 to the manifold 28.

The hydraulic system of the clamp 8 is operatively connected to the hydraulic system of the fork lift truck 5 in known manner by pressure line 31 and a fluid return line 32. The pressure line 31 is connected to a pressure regulator 33 of known commercial type to the outlet connection of which the manifold 25 is connected. Excess pressure is diverted from the regulator 33 by a line 34 to the return manifold 28.

If desired, as a precautionary measure in the invent hydraulic pressure is lost while the clamp 8 is lifting a load, check valves of known type may be included in the hydraulic system of the clamp which prevent each clamp jaw and double-acting cylinder from drifting during operation or from release on pressure failure.

The grapple clamp disclosed in my U.S. Pat. No. 4,252,496 functions very satisfactorily in handling loads of objects of uniform size and shape such as cartons or cases of beverages where a group of such cartons or cases make up a full compact load as shown in FIG. 7. Thus, the load in FIG. 7 comprises six cases of 24 cans each of a beverage such as soda or beer. Six such cartons or cases form into a solid square. Such a grouping or load lends itself particularly well to being picked up by the grapple clamp of U.S. Pat. No. 4,252,496 as well as by the grapple clamp 5 of the present invention.

However, there are occasions where the load will consist of objects which do not make up a solid, compact load as shown in FIG. 7 but will have a hollow space in the center as shown in FIG. 6. In FIG. 6, the load consists of eight cases or cartons containing 20 cans each. Such a load cannot be arranged so as to completely fill the interior of the clamp but will leave a hollow or empty space in the central portion. Such a hollow space or empty portion prevents the load from offering complete resistance to the clamping forces exerted on opposite sides. If excessive force is applied, the load yields at the center and some of the cases may be crushed or deformed. On the other hand, if the clamping force is reduced so as not to deform the exterior shape of the load, the clamping force may be inadequate to safely lift and maneuver the load as desired.

Figure 5:
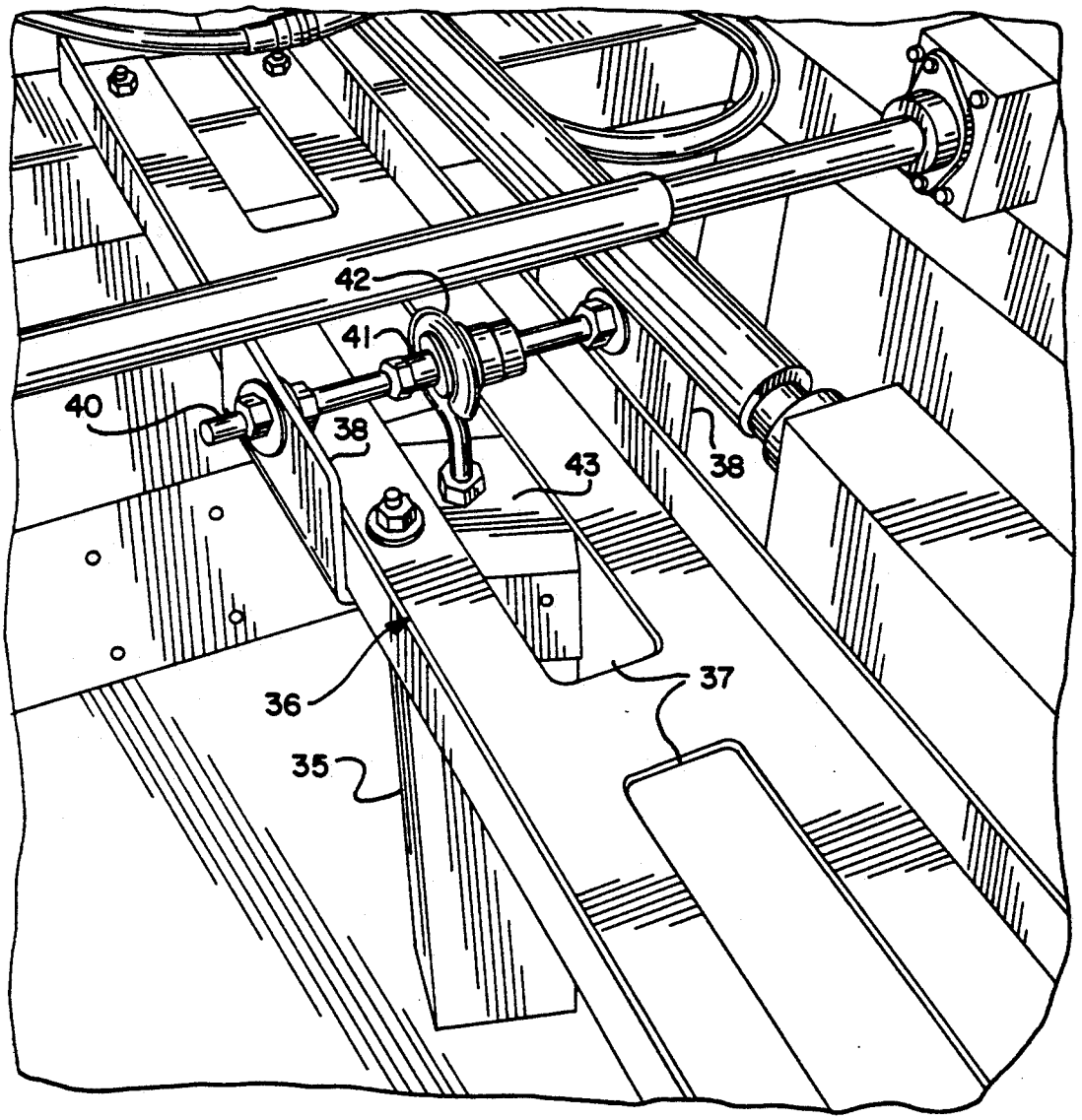
FIG. 5 is a fragmentary, vertical perspective view showing a load stabilizer block and its support.

In accordance with the present invention, this problem has been overcome by the provision of a load stabilizer block which is indicated at 35 in FIGS. 5 and 6. Such a block may take the form of a short length of a wooden four-by-four or six-by-six. This block is swingably supported from the top of the frame 10 by a cross structure 36 which may be fabricated from an inverted channel extending between the frame sides 12 with bottom openings 37—37 therein. Midway between the opposing sides 12—12, a pair of angle members 38—38 are secured to the cross support 36 to provide upstanding flanges extending above the support 36 in order to support a bolt 40. The bolt 40 may be secured in known manner by providing jam nuts thereon which secure it to each of the angle members 38. Midway between its ends, the bolt is provided with an adapter 41 which serves to position and pivotally support thereon the eye 42 of an eye bolt or eye screw, the threaded stem of which extends downwardly into the top of the load stabilizer block 35. Preferably, the block 35 is provided with a metal cap 43 to which the stem of the eye bolt may be secured. With this arrangement, the load block 35 is capable of swinging toward and away from the opposite sides 12 of the frame 10. It will be appreciated that load stabilizer blocks 35 of different shapes and sizes may be substituted depending on the configuration of the center or central spaces that may be left void in a load.

It is important to be able to readily mount the grapple clamp 8 on the forks of the lift truck 5 and to remove the grapple clamp, when desired. The mounting arrangement for the grapple clamp 8 comprises a pair of parallel beams 45—45 extending to one side of the frame 10. The beams 45 telescope within the hollow side members 11 and are secured in place therein by the set screws 46—46. At their distal ends, the beams 45 are interconnected by a cross member 47 on which is mounted a counterweight 48. The counterweight 48 serves to counterbalance to a desired degree the weight applied to the lift truck 5 by the grapple clamp 8 particularly when it is lifting a load, thereby providing greater stability to the combination of the grapple clamp 8 and the lift truck 5.

In order to receive the forks 9 of the lift truck 8, two downwardly turned channel members 50 and 51 are transversely mounted on the upper sides of the beams 45 as shown in FIGS. 2 and 3. In order to provide for a greater degree of leveling adjustment or orientation the channel 50 is deeper than the channel 51.

The right fork 9 (as viewed in FIG. 3) is secured in place in the channel 51 by means of a pair of set screw combinations 52—52 each of which comprises upper and lower set screws 53, upper and lower outer jam nuts 54 and inner jam nuts 55. Each of the lower or bottom jam nuts 54 is tightened against the underside of a cross piece 56 welded or otherwise secured to the underside of the channel member 51. The inner jam nuts 55 are tightened against the opposing sides of the fork 9.

Similar longitudinally spaced set screw combinations 60—60 are provided on the cross channel member 50. Each combination 60 comprises upper and lower set screws 61, upper and lower pairs of jam nuts 62—62, upper and lower inner jam nuts 63 and a pair of intermediate jam nuts 64. The upper pair of jam nuts 62 are tightened against the upper side of the channel member 50 while the lower set of jam nuts 62 are tightened against the underside of each cross piece 65 which is welded or otherwise secured to the underside of the channel 50. The upper jam nut 63 is tightened against the underside of the channel 50 while the lower jam nut 63 is tightened against the top of the cross piece 65. The jam nuts 64 are tightened against opposite sides of the fork 9.

It will be seen that while the set screw combinations 52 on the channel member 51 primarily serve to secure the inner fork 9 in place, the set screw combinations 60 not only should secure the associated fork 9 in place but also serve to adjust the vertical position of the fork 9 within the channel 50. By this arrangement, the clamp 8 can be leveled with respect to the plane of the forks 9.

The manner in which grapple clamp 8 operates and is used to lift a group of objects as shown in FIG. 6 will now be described. The eight cartons are loosely assembled or grouped on the floor and the lift truck is maneuvered so that the raised grapple clamp 8 is approximately directly over the assembled cartons. The grapple clamp 8 is then lowered by the operator with the opposing jaw clamps 15—15 and 16—16 tilted to their open condition as shown in FIG. 3. The grapple clamp 8 is then lowered, care being taken that the load stabilizer block 35 fits within the open center in the grouped cases or cartons. The operator on the lift truck then operates a control valve (not shown) which supplies pressure to the hydraulic hose 31 thereby causing the jaws of the clamp 8 to close together on opposite sides of the grouped cartons gently forcing them together in compacted condition as shown in FIG. 6. When the load has thus been suitably clamped, the grapple clamp 8 is then raised and the load is maneuvered to whatever desired position it is to be discharged such as on the platform of a delivery truck. When the load is in proper position on the platform, the operator reverses the control valve and the jaws 15 and 16 are opened thereby releasing the load.

What is claimed:

1. In a grapple clamp for engaging a plurality of objects with sufficient equalized clamping force from four sides to permit lifting thereof, comprising, rectangular frame means, four hinge means mounted in rectangular configuration on said frame means, an elongated clamp jaw having an elongated clamping surface carried on each of said hinge means so as to provide two pairs of elongated clamp jaws with the jaws in each pair and said clamping surfaces thereon being swingable toward and away from each other and with the direction of swinging of each pair of clamp jaws being at 90° to the direction of swinging of the other pair, said clamp jaws forming a rectangular enclosure, and an axially extendable fluid-powered actuator operably interconnected between the clamp jaws of each pair thereof for forcibly swinging the clamp jaws and clamping surfaces of each pair toward each other, each of said fluid-powered actuators having a fluid connection through which fluid under pressure may be introduced to actuate the pair of clamp jaws operably interconnected by the actuator, and common fluid conduit means interconnecting said fluid-introducing connections on said actuators whereby the clamping forces exerted by said two pairs of clamp jaws are equalized, the improvement comprising:

a vertically extending load stabilizer block, and means suspending said load stabilizer block from a central position within said rectangular frame means whereby said block serves as a solid core within a surrounding group of objects clamped together by said grapple clamp.

2. The improvement called for in claim 1 wherein said rectangular frame means is square and said load stabilizer block is suspended in the center thereof.

3. The improvement called for in claim 1 wherein said means suspending said load stabilizer block comprises a support extending transversely across said frame means and means for attaching the top of said block to said support.

4. The improvement called for in claim 3 wherein said means for attaching the top of said load stabilizer block to said transversely extending support allows said block to swing in at least one direction.

5. The improvement called for in claim 3 wherein said attaching means comprises a pair of parallel flanges mounted on opposite sides of said support, a horizontal bolt extending between said flanges, and an upright eye bolt or eye screw the eye portion of which is swingable on said bolt and the screw portion of which is secured to the top of said load stabilizer block.

6. The improvement called for in claim 1 wherein a pair of clamp support beams project laterally from two opposing sides of said rectangular frame means, a pair of hollow lift truck fork-receiving members are transversely mounted on said clamp support beams, and a pair of longitudinally spaced set-screw leveling means are mounted on at least one of said fork-receiving members for vertically adjustably engaging and clamping the top and bottom of a fork within said one fork-receiving member.

7. The improvement called for in claim 6 wherein a counter weight is mounted transversely on the distal ends of said clamp support beams.

8. The improvement called for in claim 1 wherein said fluid-powered actuators are double-acting cylinders and corresponding fluid connections at opposite ends of said cylinders are interconnected so that the fluid pressures in said corresponding connections are equalized, and a pressure regulator is interconnected in the fluid connections in which pressurized fluid is delivered to actuate said grapple clamp to clamp objects therein.

* * * * *